US005107822A

United States Patent [19]

Ohashi

[11] Patent Number: 5,107,822

[45] Date of Patent: Apr. 28, 1992

[54] APPARATUS FOR GIVING MOTIONS TO THE ABDOMEN

[75] Inventor: Keiichi Ohashi, Shizuoka, Japan

[73] Assignee: Skylite Industry Co., Ltd., Shizuoka, Japan

[21] Appl. No.: 544,650

[22] Filed: Jun. 27, 1990

[51] Int. Cl.[5] ..... A61H 1/02

[52] U.S. Cl. ..... 128/25 R; 128/25 B; 128/49; 128/52; 482/79

[58] Field of Search ..... 272/93, 96, 97, 146; 128/25, 25 B, 33-55

[56] References Cited

U.S. PATENT DOCUMENTS

| | | | |
|---|---|---|---|
| 2,397,428 | 3/1946 | Moshier | 128/25 B |
| 2,645,219 | 7/1953 | Bertholin | 128/25 B |
| 3,035,570 | 5/1962 | Nelson | 128/49 X |
| 3,088,457 | 5/1963 | Dersch | 128/49 X |
| 3,304,935 | 2/1967 | Kennedy et al. | 128/25 B |
| 3,316,898 | 5/1967 | Brown | 128/25 B |
| 3,765,407 | 10/1973 | Prince | 128/25 B X |
| 4,071,021 | 1/1978 | Gallacci | 128/52 |
| 4,711,229 | 12/1987 | Hengl | 128/52 X |

*Primary Examiner*—Robert Bahr

*Attorney, Agent, or Firm*—Wegner, Cantor, Mueller & Player

[57] ABSTRACT

An apparatus for giving twisting and swinging motions to the abdomen of a person lying on his back provided, in which an ankle rest having the ankles placed thereon is reciprocated from side to side to give twisting and swinging motions to the abdomen, and which comprises the ankle rest and a driving mechanism for reciprocating the ankle rest from side to side, the ankle rest being positioned at a height of 100 to 200 mm above the floor and reciprocating from side to side at an amplitude of 20 to 40 mm and at a speed of 100 to 200 cycles per minute.

1 Claim, 3 Drawing Sheets

APPARATUS FOR GIVING MOTIONS TO THE ABDOMEN

BACKGROUND OF THE INVENTION

1. Field of the Invention

The present invention relates to an apparatus for reciprocating both ankles from side to side to give twisting and swinging (rocking) motions to the abdomen, whereby the visceral functions of the abdomen are activated, with an increase in the amount of oxygen intake by the body, for health care purposes.

2. Prior Art

Proper exercise improves the functions of the body.

Especially when the internal organs of the abdomen are affected by such exercise, their functions are activated simultaneously with an increase in the amount of oxygen intake by the body, leading to promoting health.

For that reason, various exercises such as jogging and aerobics have been practiced for the purpose of promoting health. Many auxiliary tools for such exercises—the so-called health-care equipment—have also been available.

However, all the exercises heretofore practiced, for the most part, involve muscular motions needing some physical strength and muscular power. Hence, they are effective for a person of a certain level of physical strength or higher to gain increased muscular power, but are ill-suited for a person who is physically weak and so needs health care in a true sense of the word. In addition, their effects upon activating the visceral functions and improving health are slender relative to the amount of motion.

Further, they need much time and so are often difficult to practice.

Rather, active exercises, such as jogging and aerobics in particular, have an adverse influence upon health, because they impose increased loads upon the respiratory and circulatory organs.

SUMMARY OF THE INVENTION

A main object of the present invention is to provide kinesitherapic equipment which is designed to give twisting and swinging motions to the abdomen of the user who is lying on his back without need of any movement at all and it can be comfortably used even by a physically weak person.

According to this invention, this object is achieved by the provision of an apparatus for giving twisting and swinging motions to the abdomen, which comprises an ankle rest positioned at a height of about 100 to 200 mm above the floor and a driving mechanism for reciprocating the ankle rest from side to side, and wherein the ankle rest, on which the ankles of the user lying on his back on the floor are placed, is reciprocated from side to side at a suitable speed to give reciprocating motions to the legs.

In using the present apparatus, the ankle rest is reciprocated at a suitable speed to reciprocate the ankles thereon from side to side. Then, such reciprocating motions are transmitted to the abdomen to activate the visceral functions of the abdomen with an increase in the amount of oxygen intake by the body, thereby promoting health.

BRIEF DESCRIPTION OF THE DRAWINGS

The equipment for giving twisting and swinging motions to the abdomen according to the present invention will now be explained specifically but not exclusively with reference to the accompanying drawings, in which.

ILLUSTRATIVE EXPLANATION OF THE INVENTION

Figure 1:
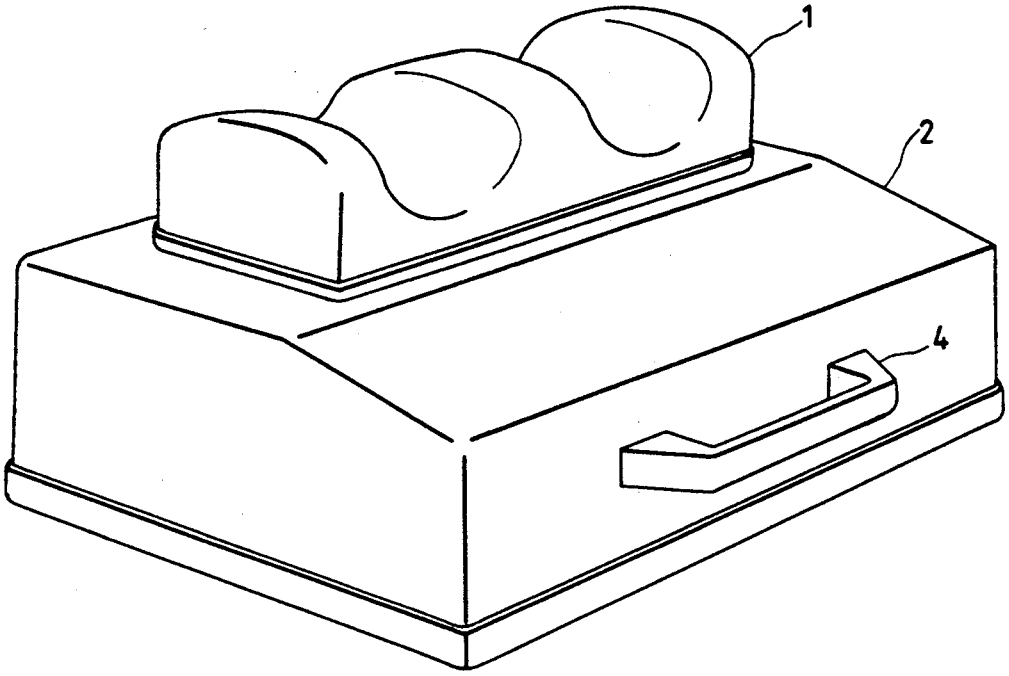
FIG. 1 is a perspective view showing one embodiment of the apparatus for giving twisting and swinging motions to the abdomen according to the present invention.
Figure 2:
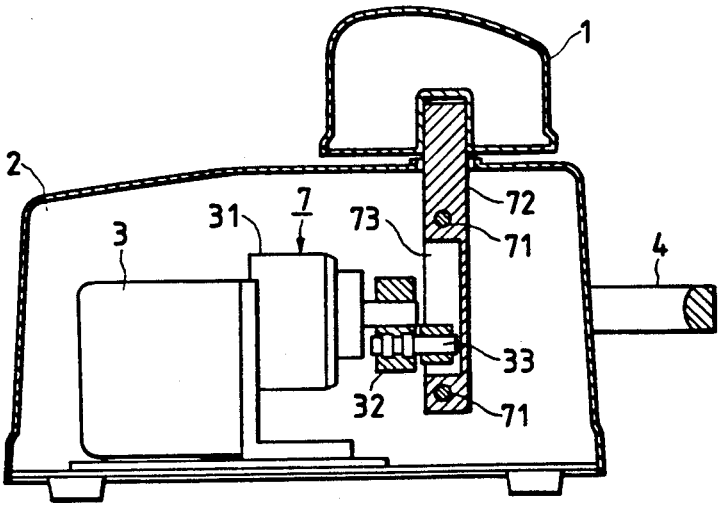
FIG. 2 is a partly cut-away side view illustrating one embodiment of the driving mechanism for reciprocating the ankle rest.
Figure 3:
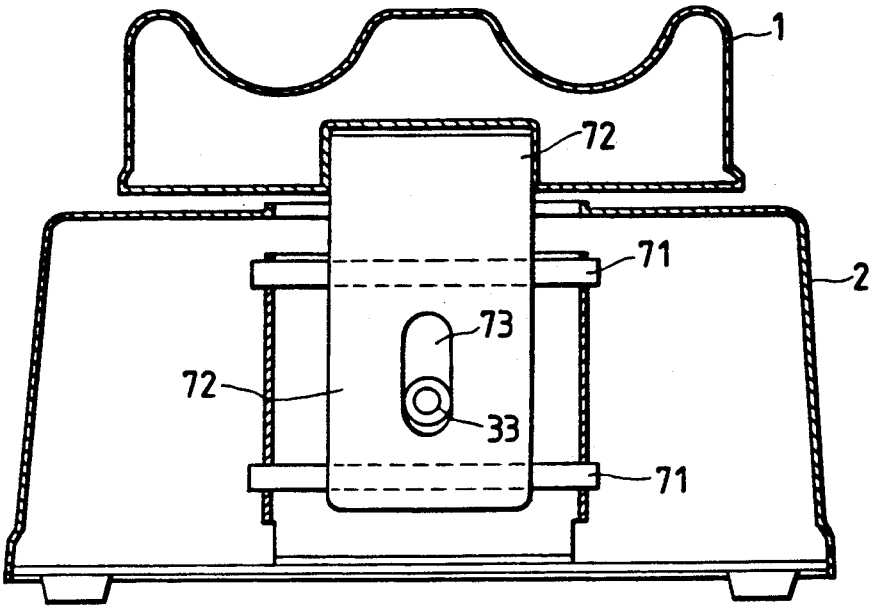
FIG. 3 is a front view of the driving mechanism.

An ankle rest 1 is provided to reciprocate both ankles from side to side. While lying on his back on the floor, the user places the ankles on the rest 1, which is then reciprocated from side to side to give swinging motions to the legs. For this reason, the ankle rest 1 has its upper face curved after the ankles to fix them in place during its reciprocation. In addition, the ankle rest 1 is located at a height of about 100 to 200 mm above the floor to prevent the legs from coming in dragging contact with the floor during use.

A casing 2, provided to support the ankle rest 1 and, at the same time, for greater safety during use, includes therein a driving motor 3 and other driving parts to prevent them from contacting the body of the user.

For the convenience of handling, the casing 2 has a handle 4, a timer switch 5, a power feed cord 6, etc. at suitable positions.

The ankle rest 1 is connected to the driving motor 3 via a driving mechanism 6 to reciprocate it from side to side.

The amplitude and vibrating speed of the ankle rest 1 during its reciprocation are not specified, and may be determined depending upon the physique of the user and the intensity of the desired swinging motions because, as will be explained later, it is designed such that the legs are reciprocated at a suitable amplitude and vibrating speed to transmit the reciprocating motions to the abdomen, whereby the abdomen is subjected to twisting and swinging motions in associated with the reciprocation of the legs.

Therefore, the ankle rest 1 is suitably reciprocated at an amplitude of about 20 to 40 mm and a vibrating speed of about 100 to 200 cycles per minute.

The driving mechanism 7 is not specified.

What is essentially required of that mechanism is that it may enable the ankle rest 1 to be smoothly reciprocated at the desired amplitude and vibrating speed. Preference is given to a mechanism capable of regulating the amplitude and vibrating speed at need.

It is noted that the driving mechanism illustrated is designed to keep constant the amplitude and vibrating speed of the ankle rest 1.

More specifically, the driving mechanism 7 comprises a pair of vertically spaced-away guide rails 71 and 71 positioned in parallel with the direction of reciprocation of the ankle rest 1, a sliding piece 72 slidably mounted to the guide rails 71 and 71 and designed to reciprocate along them from side to side, the driving motor 3 and a reduction gear 31 attached to the driving motor 3.

The reduction gear 31 has an output shaft provided with a crank arm 32, into which a pulley 33 is loosely fitted.

The sliding piece 72 is provided therein with a slot 73 whose width is substantially equal to the outer diameter of the pulley 33. The pulley 33, fitted into the slot 73, is turned to reciprocate the sliding piece 72 from side to side.

The sliding piece 72 is provided with the ankle rest 1 at its upper part extending from the casing 2, so that the ankle rest 1 can be reciprocated in association with the side-to-side movement of the sliding piece 72.

Figure 4:
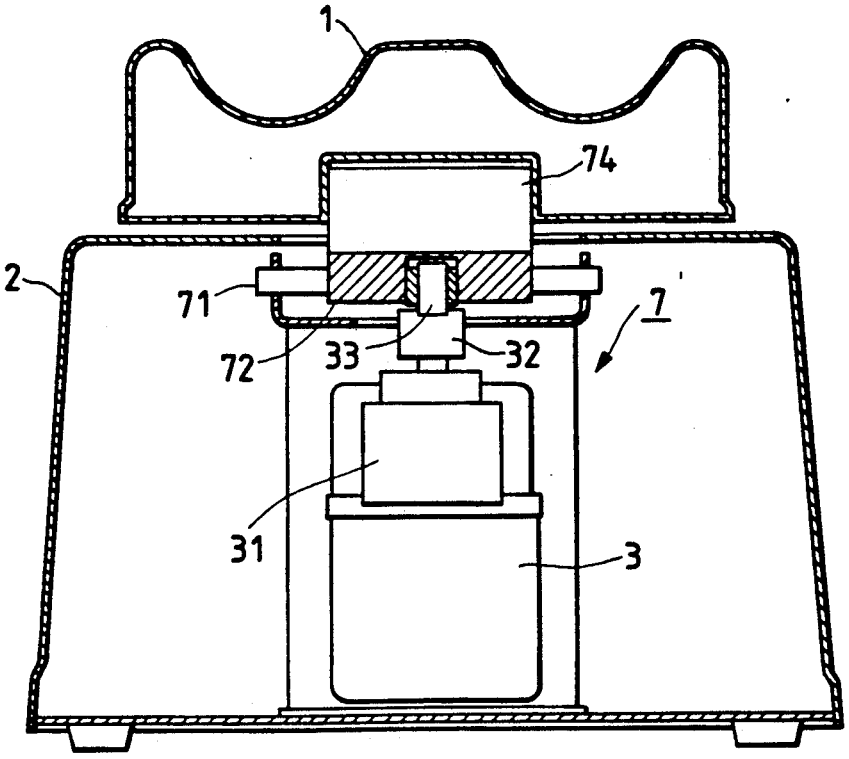
FIG. 4 is a longitudinally sectioned view of another embodiment of the present apparatus.
Figure 6:
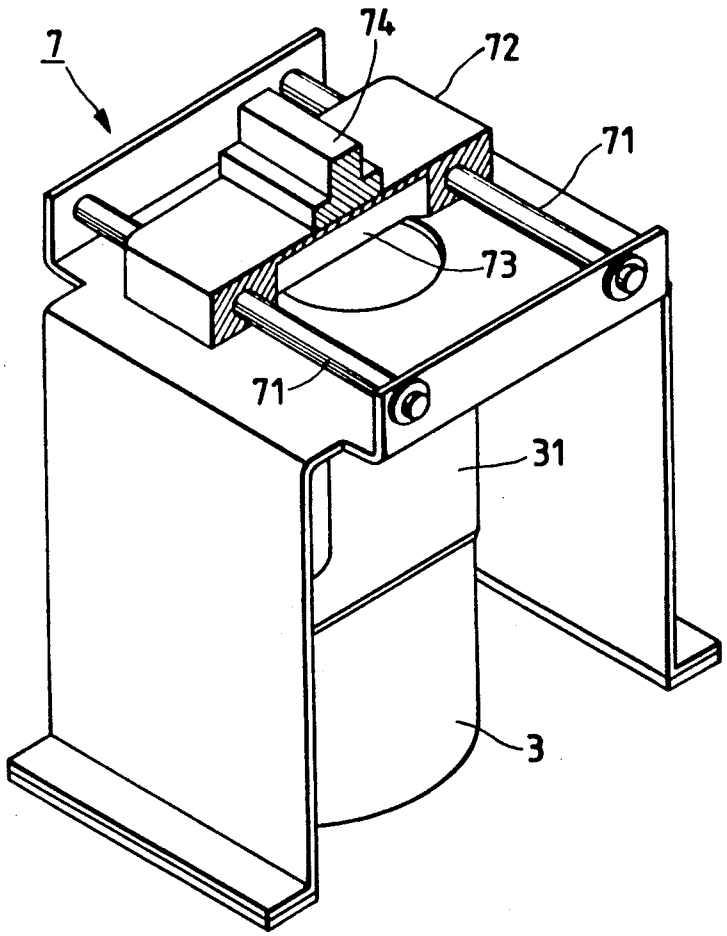
FIG. 6 is a perspective view showing part of the second embodiment.
Figure 5:
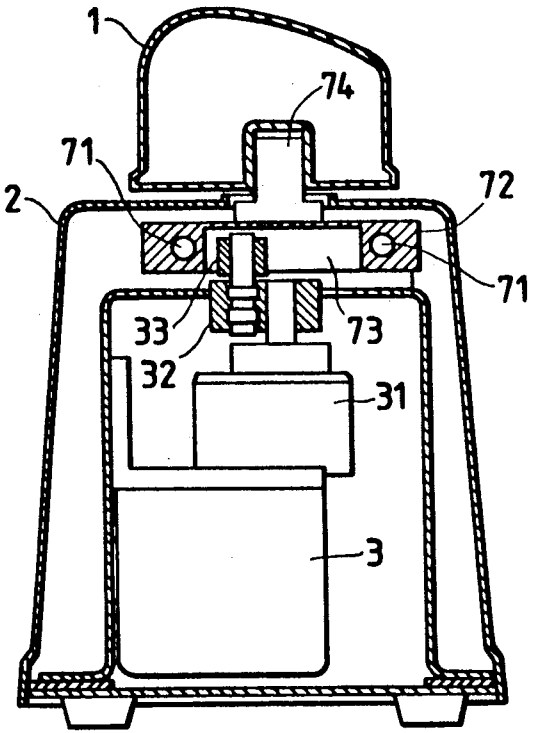
FIG. 5 is a longitudinally sectioned view of the second embodiment.

FIGS. 4 to 6 shows another embodiment of the present equipment in which a pair of guide rails are disposed above a driving motor. With the apparatus shown in FIG. 1, it is likely that the sliding piece 72 tends to be so twisted that there can be play between the sliding piece 72 and the slider portion of the guide rail 71. This is because there is a considerable gap between the position of the pulley 33 (the point of force via which the rotational force of the driving motor 3 is transmitted to the sliding piece 72) and the position at which the sliding piece 72 is mounted on the ankle rest 1 (the point of action via which the reciprocating movement of the sliding piece 72 is transmitted to the ankle rest 1). With the second embodiment in which the gap between the points of force and action is lessened, however, such a likelihood is eliminated.

The apparatus according to the second embodiment is basically similar in structure to that shown in FIG. 1.

Reference numeral 1 stands for a ankle rest and 2 a casing. The ankle rest 1, mounted on the casing 2, is designed to reciprocate at an amplitude of about 20 to 40 mm and at about 100 to 200 cycles per minute.

Within the casing 2, there are accommodated a driving motor 3 and a driving mechanism 7 for reciprocating the ankle rest 1.

Although not illustrated, the casing 2 includes a handle, a timer switch, a power feed cord, etc. at suitable positions for the convenience of handling.

The driving mechanism 7 comprises a pair of guide rails 71 and 71 positioned in parallel with the direction of reciprocation of the ankle rest 1, a sliding piece 72, the driving motor 3 and a reduction gear 31 attached to the driving motor 3. The reduction gear 31 has an output shaft provided with a crank arm 32, into which a pulley 33 is loosely fitted.

The two guide rails 71 and 71 are horizontally positioned in the vicinity of the ceiling face of the casing 2 and just beneath the ankle rest 1, and are slidably provided with the sliding piece 72.

The sliding piece 72, serving to change the rotation of the driving motor 3 to reciprocating movement and transmit it to the ankle rest 1, is provided with a slot 73 whose width is substantially equal to the outer diameter of the pulley 33 in a direction normal to the guide rail 71. The pulley 33, fitted into that slot, is turned to reciprocate the sliding piece 72 along a slider shaft 5 from side to side. On the center line of the sliding piece 72, there is further provided a connector projection 74 in parallel with the guide rail 71, which extends to the upper face of the casing 2 to mount the ankle rest 1 in place.

While the user lies on his back on the floor with the ankles placed on the ankle rest 1, the breast and the waist are brought into contact with the floor with the abdomen and the legs brought up from the floor. As the ankles reciprocates from side to side, the legs reciprocates around the waist (the hip). If the amplitude and the number of vibrations of the ankle rest 1 are suitably regulated in this state, then the abdomen twists and swings from side to side in association with the reciprocation of the legs.

With the equipment according to the present invention as detailed above, the user, lying on his back, places the ankles on the ankle rest 1 which reciprocates at an amplitude of about 2- to 40 mm and a speed of about 100 to 200 cycles per minute. The ankles are then reciprocated from side to side to reciprocate the legs around the hip from side to side, whereby the abdoment is twisted and swung.

In consequence, the visceral functions of the abdomen are so promoted that they can be activated with an increase in the amount of oxygen intake by the body, thus improving health. In addition, this can be practiced while the user lies on his back without need of any movement at all. Thus, the present apparatus have the advantage of being able to be very easily and comfortably used even by a physically weak person.

What is claimed is:

1. An apparatus for giving twisting and swinging motions to the abdomen of a user lying on his back, said apparatus comprising:

an ankle rest for receiving the ankles of the user thereon;

driving means for reciprocatingly driving said ankle rest from side to side, said driving means including a pair of horizontally spaced guide rails extending in the direction of reciprocation of said ankle rest, a sliding piece slidably mounted on said guide rails and having a slot, a motor, a reduction gear connected to said motor, and a crank arm connected to said reduction gear and having a pulley slidably engaged in said slot;

a casing in which said driving means is mounted so that said guide rails are disposed adjacent a ceiling face of said casing above said motor; and said ankle rest being positioned at a height of 100 to 200 mm above the floor and reciprocating from side to side at an amplitude of 20 to 40 mm and at a speed of 100 to 200 cycles per minute;

wherein when the user lies on his back on the floor with his ankles placed on said ankle rest, the user's chest and waist are brought into contact with the floor while the abdomen and legs are raised off the floor, and, as the ankles reciprocate from side to side, the legs reciprocate about the waist and the abdomen twists and swings from side to side in association with the reciprocation of the legs.

* * * * *